US005653424A

United States Patent [19]

Khan

[11] Patent Number: 5,653,424

[45] Date of Patent: Aug. 5, 1997

[54] STAPLE REMOVER HAVING A SLIDABLE CLAW MEMBER

[76] Inventor: Saheed Khan, 11746 Ovide Clermont, Montreal, Quebec, Canada, H1G 3Z3

[21] Appl. No.: 535,042

[22] PCT Filed: Nov. 23, 1994

[86] PCT No.: PCT/CA94/00648

§ 371 Date: Oct. 13, 1995

§ 102(e) Date: Oct. 13, 1995

[87] PCT Pub. No.: WO95/14554

PCT Pub. Date: Jun. 1, 1995

[30] Foreign Application Priority Data

Nov. 23, 1993 [GB] United Kingdom ..... 9324029

[51] Int. Cl.[6] ..... B25C 11/00

[52] U.S. Cl. ..... 254/28

[58] Field of Search ..... 254/28; 227/63

[56] References Cited

U.S. PATENT DOCUMENTS 2,631,816 3/1953 Neilsen .

3,009,155 10/1961 Leniz .

3,528,643 9/1970 Munson .

4,513,951 4/1985 Rogers .

5,090,663 2/1992 Crutchfield et al. .

*Primary Examiner*—Robert C. Watson

[57] ABSTRACT

A staple remover for removing staples from stapled sheets and material. The staple remover has a handle and a set of interchangeable blades which can be releasably fixed to the front end of the handle. The blades extend through an aperture provided in the handle. The blades have a frontwardly tapering configuration. The blades are adapted to be slid between the stapled sheets and the crown section of the staple. Slidable insertion of the blade causes the staple to unclench. The staple remover also has a claw member slidably fixed to the substantially hollow handle. The claw member is adapted to pull the staples unclenched by the blade from the blade into the hollow handle. The hollow handle communicates with a used staple storage compartment. The used staple storage compartment is snappingly fixed to the handle and can be easily removed from the latter. The structure of the staple remover allows for the quick and easy fixing of interchangeable blades of different sizes to the handle.

8 Claims, 9 Drawing Sheets

XXIII
XXIII
A2
A3
WB
WB 38
102
106
58
108
100
110
92
94
90
82
98
84

38
D6
106
58
56
112
102
108
100
110
84
92
94
90
82
98
D5

38
58
56
102
106
108
112
100
110
92
84
94
90
82
98
D5

102
110
106
92
84
30
D7
100
134
90
32
94
78
D7
92
32
82
90
98
80

102
110
94
106
84
100
90
134
D7
102
106
32
30
92
80
134
D7
90
82
98
78

STAPLE REMOVER HAVING A SLIDABLE CLAW MEMBER

FIELD OF THE INVENTION

The present invention relates to the field of staple removers and is particularly concerned with an ergonomic staple remover having a set of interchangeable blades for unclenching the staples and lifting them away from the stapled sheets and a claw assembly for graspingly pulling the removed staples towards a removable storage compartment.

BACKGROUND OF THE INVENTION

The art of staple removers is replete with various devices for removing conventional staples clenched on paper-type material. A relatively large number of staple removing devices are of the so-called "jaw-type". U.S. Pat. No. 4,054,263 issued to Michael Delia on Oct. 18, 1977, constitutes a typical example of a patent disclosing a so-called "jaw-type" staple remover.

These so-called "jaw-type" devices incorporate a pair of oppositely disposed cooperable jaws. Both jaws have upper and lower camming surfaces adapted to be inserted between the crown portion of a staple and the material to which the staple is attached. When the jaws are forced together, they simultaneously press upwardly on the crown portion of the staple and downwardly on the material. The staple is thus pulled out of the material.

The so-called "jaw-type" of staple removers suffers from a set of drawbacks. Firstly, they are relatively difficult and awkward to operate. They require a certain amount of manual dexterity and occasionally damage the fingernails of the user. Secondly, they often lead to tearing or damaging of both the staple and the sheet to which it is attached during the staple removing operation.

Thirdly, although some "jaw-type" staple removers has built-in components for retaining the removed staples, most of these staple retaining components have proven to be both costly and inefficient. Consequently, commercially successful "jaw-type" staple removers are sold without any staple retaining component and the removed staples must be disposed of one at a time by hand.

Although this problem might seem at first trivial it sometimes leads to more serious situations. Staples removed individually by hand frequently find their way on desk surfaces or floors as well as adjacent structures and equipment. The used staples which tend to become scattered clutter the premises.

The used staples occasionally fall by gravity onto the floor surface. When the floor surface is covered with a carpet, the sharp end portions thereof typically become embedded in the carpet by pressure contact with shoes as persons walk on the carpet. The staples after becoming wholly or partially embedded in the carpet are removed therefrom only with great difficulty. Not only do the used staples impart an unsightly appearance to the carpet when they are partially embedded therein, but they may also potentially cause serious injury to a child inadvertently trying to swallow them. Furthermore, if the used staples fall between the various operating parts of office machines such as photocopiers, they could potentially cause malfunctions and damages.

Another type of conventionally used staple remover is the so-called "blade-type" staple remover. An example of such staple remover is disclosed in U.S. Pat. No. 3,625,482 issued on Dec. 7, 1971, to Charles F. Viel III and in U.S. Pat. No. 4,513,951 issued on Apr. 30, 1985, to E. Mark Rodgers.

The so-called "blade-type" of staple removers has a forwardly projecting blade adapted to be inserted between the crown of the staple and the top surface from which the staple is to be removed. The blade typically has a forwardly tapering configuration. As the blade is slid between the crown section of the staple and the top surface of the material from which it is being removed, the thickness of the blade increases thus pushing the staple upwardly and unclenching it. Although relatively easier to operate than the so-called "claw-type" of staple removers, the so-called "blade-type" of staple removers also suffers from a set of drawbacks.

Indeed, even though the structures disclosed in both hereinbefore cited patents are provided with means for storing removed staples, in order for the removed staples to reach the removed staple storage area, the user must slide the device along a distance at least equivalent to the length of the blade. The relatively long sliding motion is non ergonomic. Furthermore, because of the resilient nature of the staple legs and their tendency to spring back towards their clenched configuration, the staples have a tendency to frictionally abut against the blade and thus to jam the device.

U.S. Pat. No. 2,631,816 issued to H. L. Neilsen on Jun. 14, 1948, and U.S. Pat. No. 2,741,457 issued to R. T. Furumizo on Apr. 10, 1956, disclose yet another type of staple removing device. These so-called "hybrid-type" of devices use both a blade and a jaw member. The blade extends forwardly from a handle. A jaw member slidably mounted on the handle is adapted to pull the staple onto the blade using finger pressure. These so-called "hybrid-type" of devices circumvent the problem of having to slide the staple remover over a relatively long distance. However the prior art "hybrid-type" of devices has proven to be relatively inefficient. Furthermore, the prior art "hybrid-type" of devices is not provided with storage compartments for storing used staples.

SUMMARY OF THE INVENTION

Accordingly, it is an object of the present invention to provide an improved staple remover. The staple remover in accordance with the present invention is adapted to circumvent the above mentioned disadvantages.

Advantages of the present invention include the fact that the staple remover in accordance with the present invention allows for the removal of clenched staples using relatively simple and ergonomic movements.

The staple remover in accordance with the present invention has a handle which is adapted to receive interchangeable blades. The blades are adapted to be selected according to the type and size of the staples to be removed.

The staple remover in accordance with the present invention is provided with a storage compartment for temporarily storing removed staples prior to discarding them. The storage compartment is designed so as to be easily fixed and removed to and from the handle. The storage compartment also acts as a complementary base for providing the staple remover with a relatively large contact surface. The relatively large contact surface ensures a stable contact with the surface from which the staple is being removed.

The staple remover in accordance with the present invention is provided with a jaw-type component for pushing the removed staples towards the storage compartment. The jaw-type component eliminates the need for sliding the staple remover along a relatively long distance.

The staple remover in accordance with the present invention has built-in features adapted to minimize the risk of having staples jam in the device during the staple removing operation.

The staple remover in accordance with the present invention is adapted to conform to conventional forms of manufacturing so as to provide a staple remover which is economically feasible.

In accordance with an embodiment of the present invention, there is provided a staple remover for removing a staple from a sheet of material, the staple having a crown section and a pair of integrally depending staple legs, the sheet having a sheet top surface, the staple remover comprising a main body, the main body having a main body frontward end and a main body rearward end, a removed staples storage compartment formed in the main body for temporarily storing removed staples, a staple removing blade for disengaging the staple from the sheet, the staple removing blade being attached to the main body frontward end, a communicating means positioned between the staple removing blade and the removed staples storage compartment for allowing through passage of the staple from the staple removing blade to the removed staples storage compartment, a claw member slidably mounted to the main body, the claw member having a claw member contacting section for abuttingly contacting the crown section of the staple, the claw member being slidable between a claw first position wherein the claw member contacting section is in a substantially overlying relationship with the staple removing blade and a claw second position wherein the claw member contacting section is in a substantially overlying relationship with the communicating means whereby, the staple removing blade is adapted to be slid between the top surface of the sheet of material and the crown section of the staple for disengaging the latter from the sheet and the claw member is adapted to pull the staple from the staple removing blade to the communicating means, towards the used staple storage compartment.

Preferably, the staple remover further comprises a biasing means for biasing the claw member towards the claw first position.

Conveniently the main body comprises a handle member and the removed staples storage compartment is releasably fixed to the handle member.

Preferably, the staple removing blade is releasably attached to the main body frontward end.

Conveniently, the communicating means includes a stopping means for selectively allowing the staple to move from the staple removing blade to the removed staples storage compartment while preventing the staple from moving from the removed staples storage compartment to the staple removing blade.

In a preferred embodiment, the communicating means is a passage formed in the main body.

Conveniently, the handle member is provided with an internal guiding means for guiding the slidable movement of the claw member between the first claw position and the second claw position.

Preferably, the staple removing blade has a blade bottom surface, the handle member comprising a substantially flat handle abutment wall and a substantially hollow and elongated grasping section, the grasping member extending substantially upwardly and rearwardly from the handle abutment wall, the handle abutment wall having an abutment wall frontward peripheral edge, the abutment wall frontward peripheral edge having a blade receiving indentation formed therein, the blade receiving indentation being adapted to slidably receive and releasably attach therein the staple removing blade with the blade bottom surface in a substantially coplanar relationship relatively to the handle abutment wall, the grasping member having a grasping member frontward end, the grasping member frontward end being provided with a notch extending from the blade receiving indentation for allowing through passage of the staple from the blade to a position inside the grasping member.

BRIEF DESCRIPTION OF DRAWINGS

An embodiment of the invention will now be described, by way of example, in reference to the following drawings in which.

DETAILED DESCRIPTION

Figure 1:
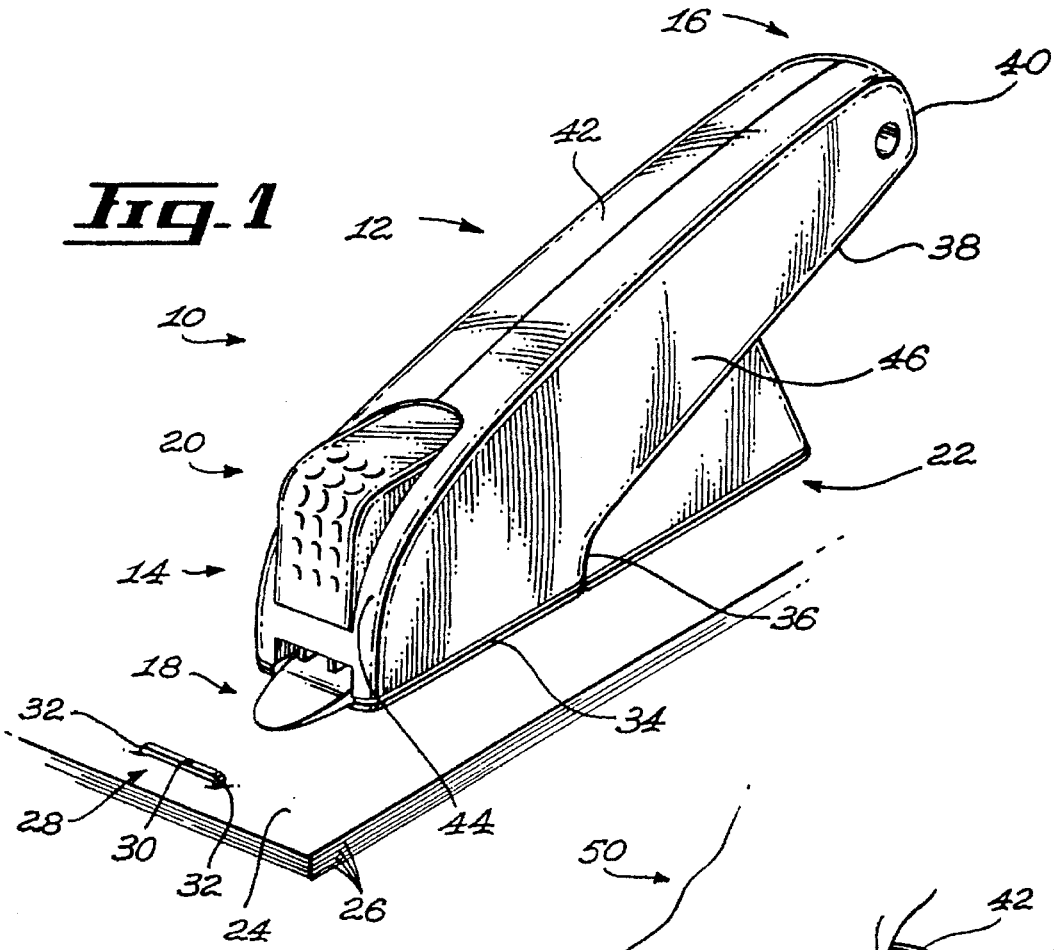
FIG. 1: in a perspective view, illustrates a staple remover in accordance with an embodiment of the present invention abuttingly resting on a pile of stapled sheets.

Referring to FIG. 1, there is shown a staple remover 10 in accordance with an embodiment of the present invention. The staple remover 10 has a substantially elongated handle-casing member 12. The handle-casing member 12 has a handle frontward end 14 and a handle rearward end 16.

A staple lifting blade 18 is releasably attached to the handle frontward end 14. A claw assembly 20 slidably mounted to the handle-casing 12 protrudes through the handle frontward end 14. A staple container 22 is releasably attached to the handle-casing member 12 intermediate the handle frontward end 14 and the handle rearward end 16.

The staple remover 10 is shown abuttingly resting on the top surface 24 of a stack of stapled sheets 26. The sheets 26 are stapled together by a conventional staple 28. The staple 28 has a substantially elongated crown section 30 and a pair of integrally extending leg sections 32.

The handle casing member 12 has a substantially flat handle abutment wall 34. A handle rear spacing segment 36 extends substantially perpendicularly and upwardly from the handle abutment wall 34. The handle rear spacing segment 36 bends integrally and substantially arcuately into a substantially flat handle bottom wall 38. The handle bottom wall 38 extends integrally and substantially perpendicularly into a substantially flat handle rearward wall 40. The handle rearward wall 40 bends integrally, arcuately and substantially perpendicularly into a substantially flat handle top wall 42. The handle top wall 42 bends integrally and arcuately into a substantially arcuate handle front wall 44.

Figure 4:
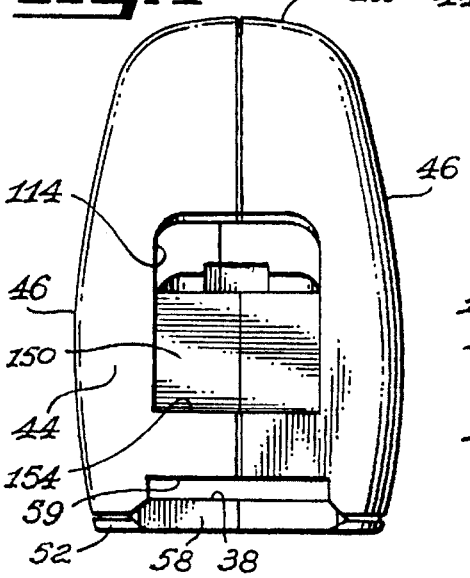
FIG. 4: in a front view, illustrates a handle-casing part of a staple remover in accordance with an embodiment of the present invention.
Figure 5:
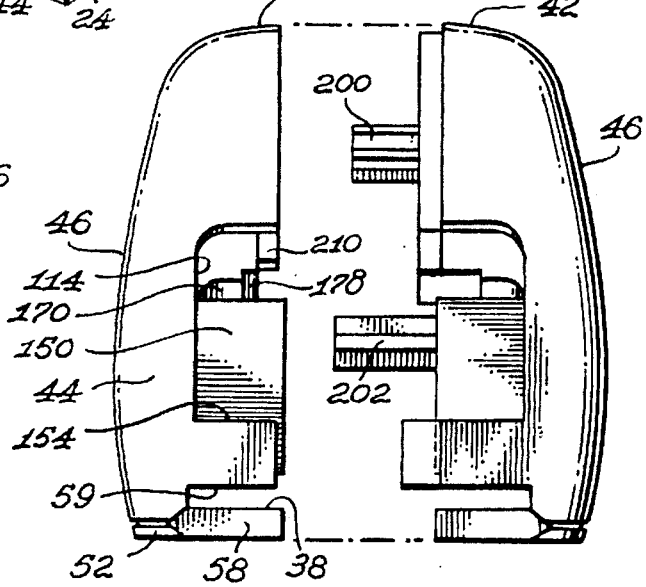
FIG. 5: in a front view, illustrates a handle-casing part of a staple remover in accordance with an embodiment of the present invention being separated into two longitudinal halves sections.

A pair of correspondingly-shaped handle side walls 46 extends integrally from the handle abutment wall 34, the handle rear spacing segment 36, the handle bottom wall 38, the handle rearward wall 40, the handle top wall 42 and the handle front wall 44. As illustrated in FIGS. 4 and 5, the handle side walls 46 preferably have a substantially convex transversal configuration.

Figure 2:
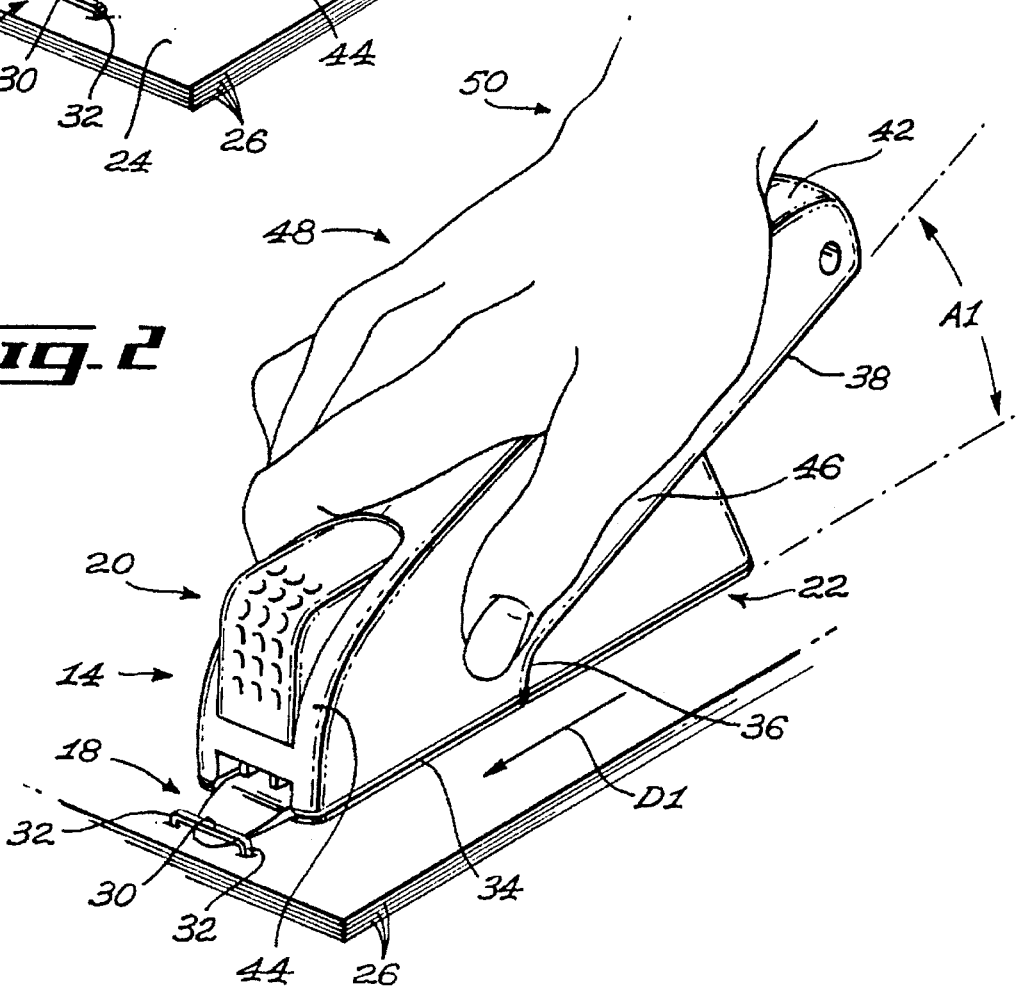
FIG. 2: in a perspective view, illustrates a staple remover in accordance with an embodiment of the present invention being slidably pushed towards a conventional staple. A blade component part of the staple remover is shown being inserted between the crown section of a conventional staple and the top surface of the pile of stapled sheets.

The handle abutment wall 34 and the handle bottom wall 38 are angled relatively to each other. The angle defined between the handle abutment wall 34 and the handle bottom wall 38 is illustrated in FIG. 2 by the reference characters A1. The handle top wall 42 extends generally in substantially the same direction as the handle bottom wall 38.

Figure 12:
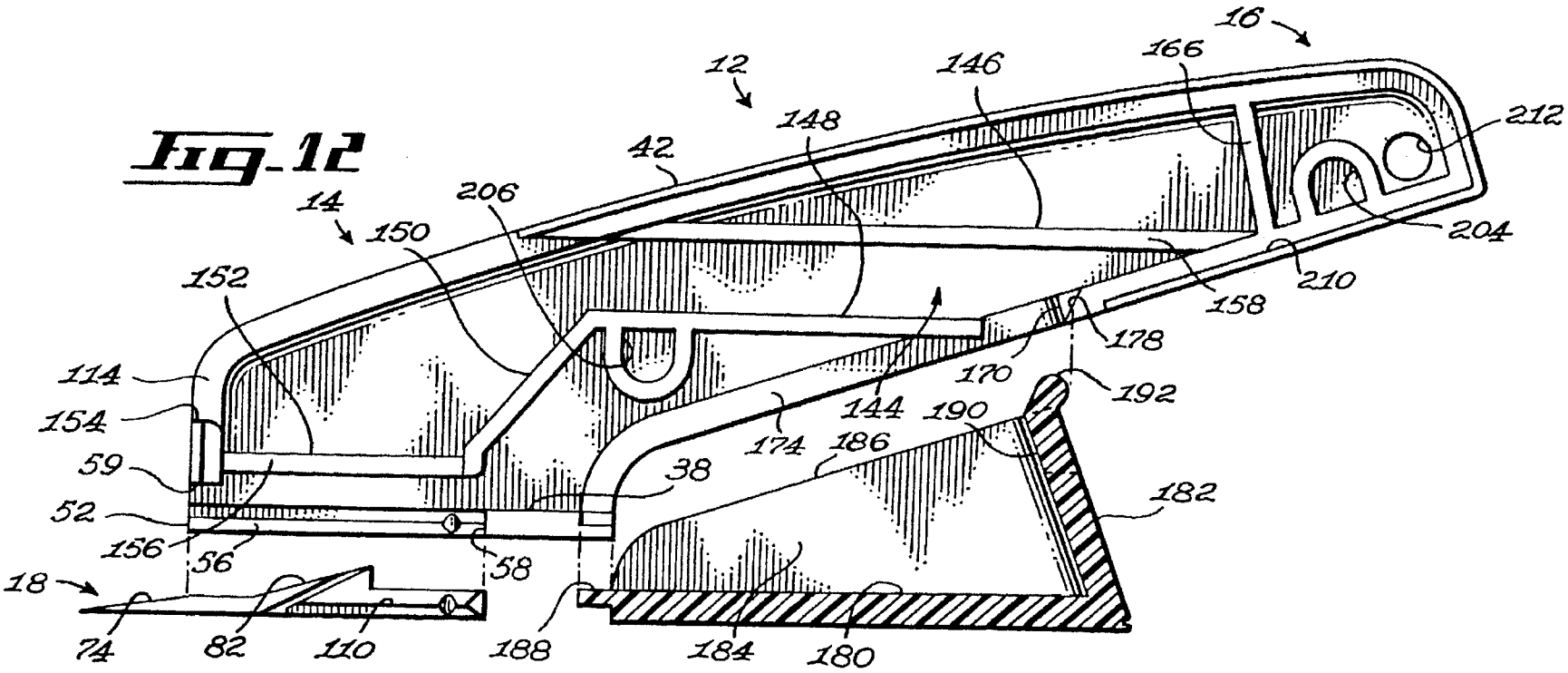
FIG. 12: in an elevational exploded view, illustrates a longitudinal half section of a handle-casing, a lifting blade, and a storage compartment, all part of a staple remover in accordance with an embodiment of the present invention.
Figure 13:
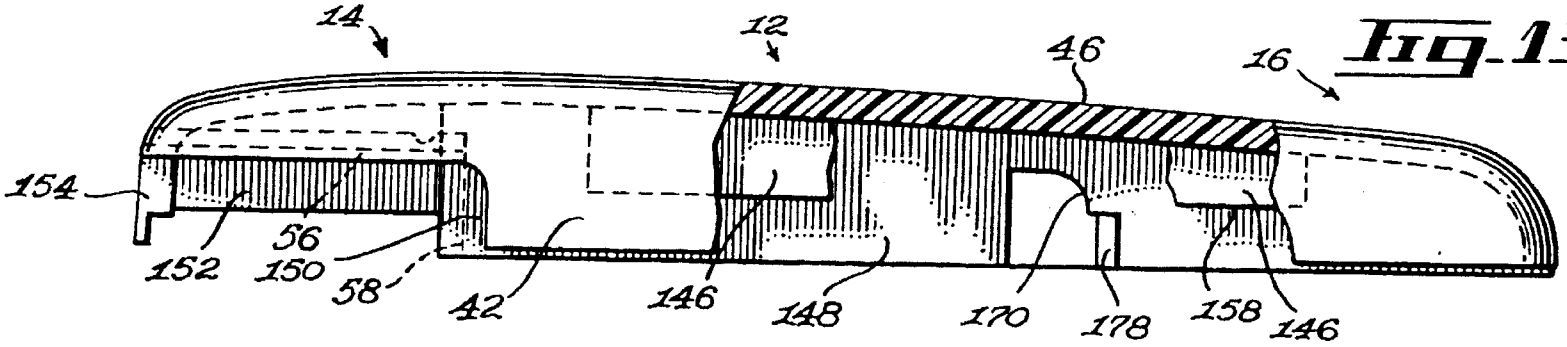
FIG. 13: in a top view with sections taken out, illustrates a longitudinal half section of a handle-casing part of a staple remover in accordance with an embodiment of the present invention.
Figure 14:
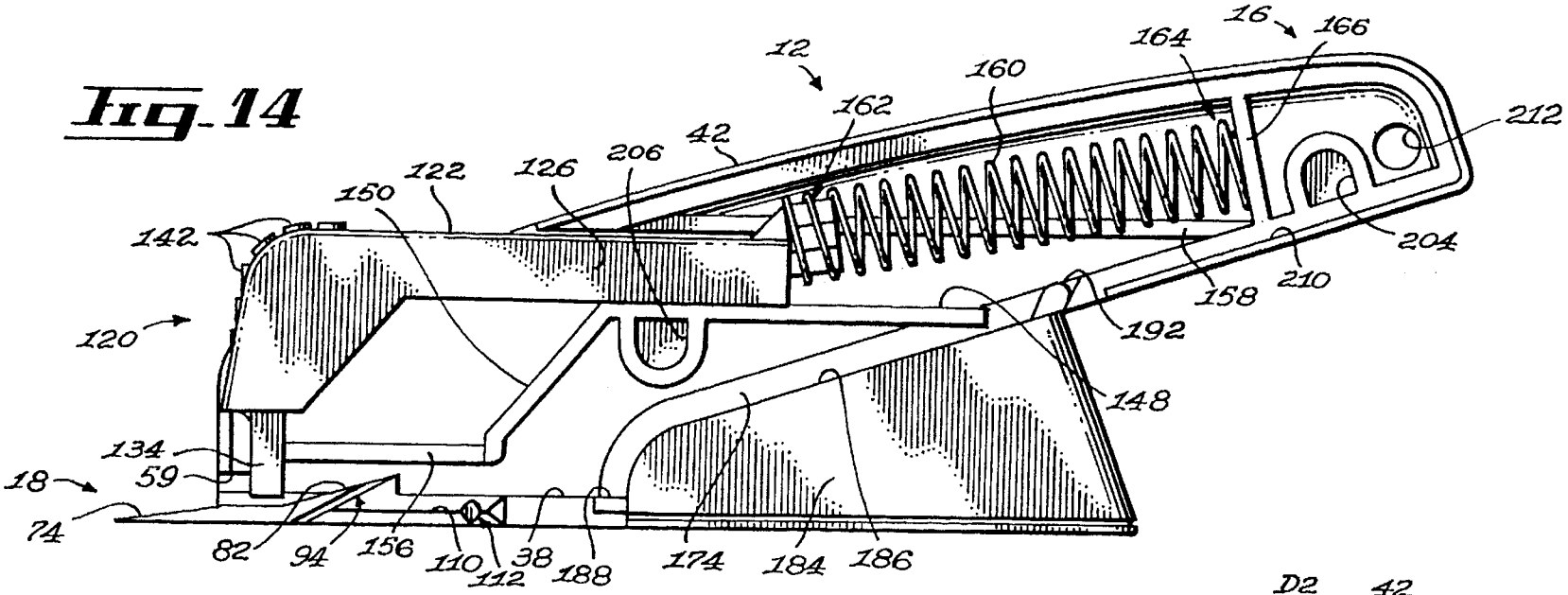
FIG. 14: in an elevational view, illustrates a longitudinal half section of a handle-casing having a claw member, a storage compartment and a lifting blade operatively attached thereto, the handle-casing, the claw member, the storage compartment and the lifting blade being part of the staple remover in accordance with an embodiment of the present invention.

As illustrated in FIGS. 12 and 14, the handle top wall 42 preferably has a substantially longitudinally convex configuration. The handle top wall 42 and the handle side walls 46 are adapted to form a substantially elongated grasping section. As illustrated in FIG. 2, the handle top wall 42 and the handle side walls 46 are configured and sized so as to be ergonomically grasped by the hand 48 of a user. In order to facilitate understanding of the drawings, the hand 48 is shown in a substantially smaller proportional scale than the staple remover 10. It should be understood that the scale of the staple remover 10 can vary without departing from the scope of the present invention.

The angle A1 between the handle abutment wall 34 and the general direction of the handle top wall 42 allows for an ergonomical positioning of the wrist 50 of the user grasping the staple remover 10 when the handle abutment wall 34 abuttingly rests on the top surface 24 of the stapled sheets 26. Typically, the angle between the handle abutment wall 34 and the handle bottom wall 38 is substantially in the range of approximately 15 degrees.

As illustrated more specifically in FIGS. 8 through 11, the handle abutment wall 34 has an abutment wall frontward peripheral edge 52. The abutment wall frontward peripheral edge 52 is provided with a blade receiving indentation 54. The blade receiving indentation 54 has a generally rectangular-shaped configuration.

The blade receiving indentation 54 has a pair of indentation side walls 56 extending substantially perpendicularly and integrally from the abutment wall frontward peripheral edge 52. Each indentation side wall 56 has a substantially "V"-shaped convex cross-sectional configuration. The blade receiving indentation 54 also has an indentation back wall 58 extending between the indentation side walls 56 in a substantially perpendicular relationship therewith. A blade locking pin 60 projects outwardly from each indentation side wall 56 adjacent the indentation back wall 58. The blade receiving indentation 54 is adapted to slidably receive a lifting blade 18.

A clearance indentation 59 is formed in the lower peripheral edge of the handle front wall 44. The clearance indentation 59 is adapted to be substantially in register with the blade receiving indentation 54. The clearance indentation 59 is adapted to allow through passage in the handle front wall 44 of the lifting blade 18 and of the staples 28 being pulled inside the handle-casing member 12 by the claw assembly 20.

The lifting blade 18 is illustrated more specifically in FIGS. 21 through 25. The lifting blade 18 has a substantially flat blade bottom wall 62. When the lifting blade 18 is inserted in the blade receiving indentation 54, the blade bottom wall 62 is in a substantially coplanar relationship with the handle abutment wall 34. The lifting blade 18 has a blade insertion section 64, a blade intermediate section 66, a blade lifting section 68 and a blade connecting section 70.

As illustrated in FIG. 2, the blade insertion section 64 is adapted to be slidably inserted between the top surface 24 of the pile of stapled sheets 26 and the crown section 30 of the staple 28. Referring back to FIG. 25, the blade insertion section 64 has a substantially arcuate frontward peripheral edge 72. The blade insertion section 64 also has a frontwardly tapering insertion section top wall 74. The insertion section top wall 74 intercepts the blade bottom wall 62 to define the blade frontward peripheral edge 72.

The insertion section top wall 74 has a substantially rectilinear insertion section rear peripheral edge 76. The insertion section rear peripheral edge 76 merges integrally with the blade intermediate section 66. The blade intermediate section 66 has a substantially flat intermediate section top wall 78. The intermediate section top wall 78 has an intermediate section rear peripheral edge 80. The intermediate section rear peripheral edge 80 merges integrally with the blade lifting section 68.

Figures 21, 22, 23, 24, 25:
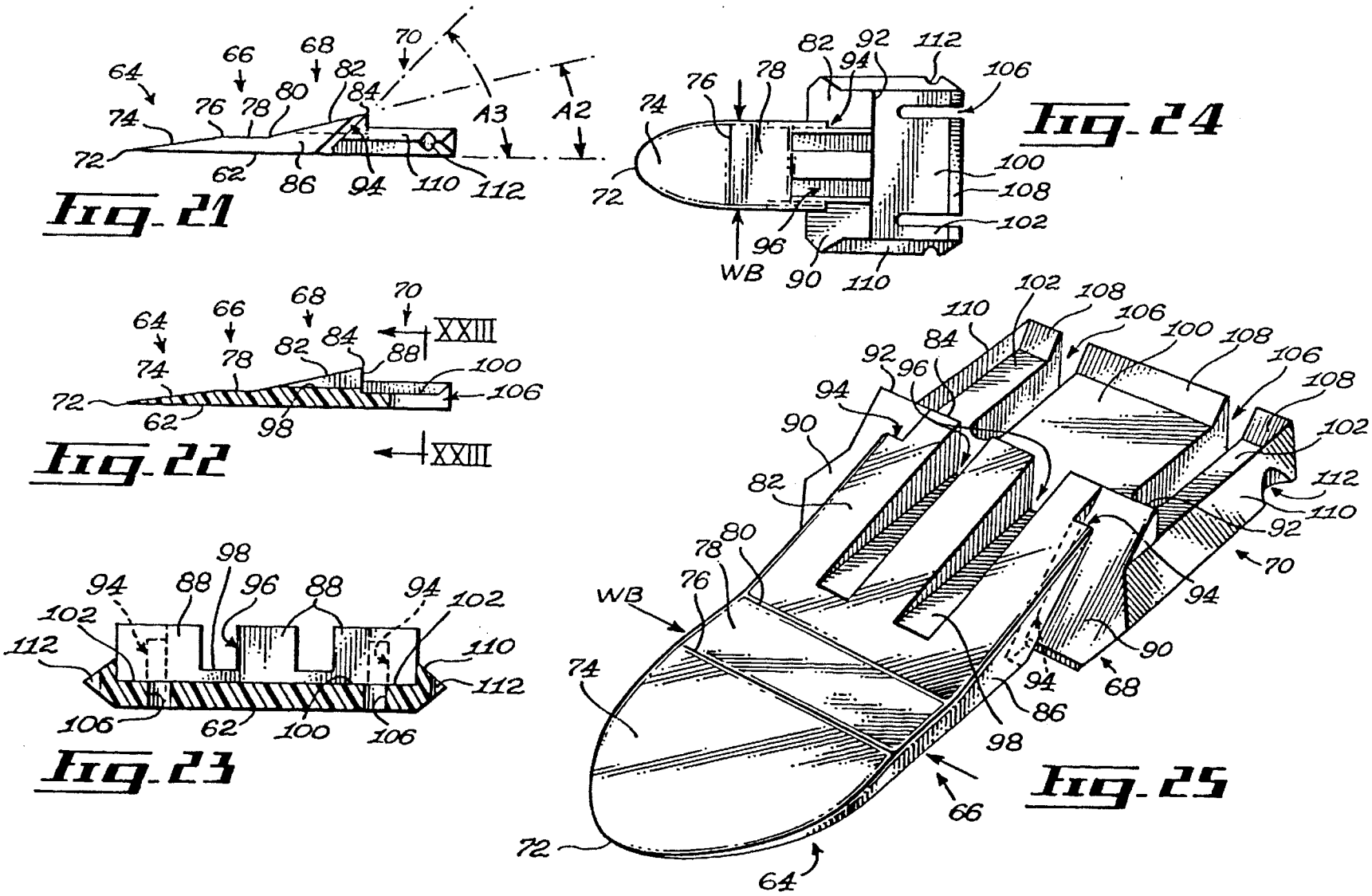
FIG. 21: in an elevational view, illustrates a first embodiment of a blade part of a staple remover in accordance with an embodiment of the present invention.
FIG. 22: in a longitudinal cross-sectional view taken along lines XXII—XXII of FIG. 20, illustrates a first embodiment of a lifting blade part of a staple remover in accordance with an embodiment of the present invention.
FIG. 23: in a transversal cross-sectional view, illustrates a first embodiment of a lifting blade part of a staple remover in accordance with an embodiment of the present invention.
FIG. 24: in a top view, illustrates a second embodiment of a lifting blade part of a staple remover in accordance with an embodiment of the present invention.
FIG. 25: a perspective view, illustrates a first embodiment of a lifting blade part of a staple remover in accordance with an embodiment of the present invention.

The blade lifting section 68 has a frontwardly tapering crown abutting wall 82. The crown abutting wall 82 extends from the intermediate section rear peripheral edge 80 to a crown abutting wall upper peripheral edge 84. The angle between the crown abutting wall 82 and the blade bottom wall 62 is indicated in FIG. 21 by the reference characters A2. The angle A2, typically has a value substantially in the range of approximately 15 degrees.

A pair of blade first side walls 86 extends integrally from the blade bottom wall 62 to the side peripheral edges of the insertion section top wall 74, the intermediate section top wall 78 and the crown abutment wall 82. A lifting section back wall 88 extends integrally and substantially downwardly from the crown abutting wall upper peripheral edge 84. The lifting section back wall 88 extends in a geometrical plane substantially perpendicular to the blade bottom wall 62. The lifting section back wall 88 extends from the crown abutment wall upper peripheral edge 84 to the blade connecting section 70. The lifting section back wall 88 extends laterally on each side beyond the blade first side wall 86.

An interrupted, frontwardly tapering leg abutment wall 90 extends integrally from the sections of the upper peripheral edge 92 which extend laterally beyond the blade first side walls 86. The leg abutment wall 90 is thus rearwardly and laterally disposed relatively to the crown abutting wall 82. The leg abutment wall 90 extends from the leg abutment wall upper peripheral edge 92 to the blade bottom wall 62.

The leg abutment wall 90 is angled relatively to the blade bottom wall 62. The angle between the blade bottom wall 62 and the leg abutment wall 90 is indicated in FIG. 21 by the reference characters A3. The angle A3 typically has a value substantially in the range of approximately 30 degrees.

A leg receiving slot 94 is formed in each blade first side wall 86 adjacent a proximal leg abutment wall 90. The leg receiving slots 94 extend from the blade bottom wall 62 to the leg abutment wall peripheral edge 92 in a substantially parallel relationship with the proximal leg abutment wall 90.

A pair of tine receiving slots 96 extends through the blade lifting section 68. The tine receiving slots 96 extend from a frontward end of the crown abutting wall 82 located adjacent the intermediate section rear peripheral edge 80 to the lifting section back wall 88. Each tine receiving slot 96 has a tine receiving slot bottom wall 98. The tine receiving slot bottom walls 98 are in a substantially parallel relationship with the blade bottom wall 62.

The blade connecting section 70 has a substantially flat configuration. The blade connecting section 70 has a substantially centrally disposed connecting section central blade 100 and a pair of substantially laterally disposed connecting section resilient prongs 102. The connecting section 70 has a connecting section frontward end which merges with the lifting section back wall 88 and a connecting section rearward end 104.

A pair of connecting section spacing slots 106 extends from the connecting section rearward end 104 between the connecting section central blade 100 and the laterally disposed connecting section resilient prongs 102. The connecting section rearward end 104 is provided with a substantially upwardly slanted peripheral flange 108.

A blade second side wall 110 extends laterally from the connecting section resilient prongs 102 and the lateral peripheral edge of the leg abutment wall 90. The blade second side wall 110 has a substantially "V"-shaped convex cross-sectional configuration. The blade second side wall 110 is configured and sized so as to be slidably and fittingly insertable in the indentation side walls 56.

Figures 26, 27, 28, 29, 30:
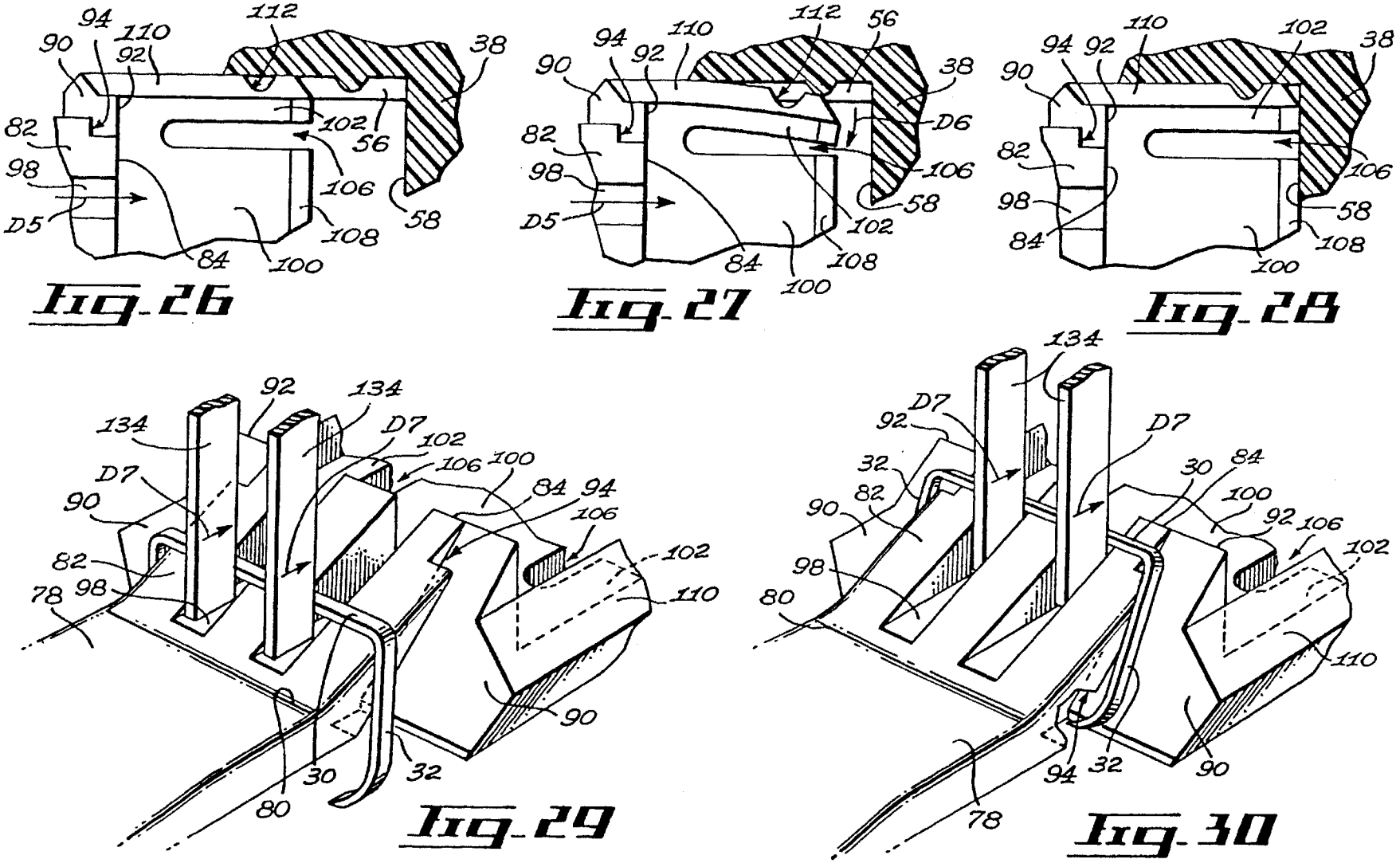
FIG. 26: in a partial transversal cross-sectional view taken along a side portion of the rearward peripheral edge and a rear portion of the side peripheral edge of a blade receiving indentation formed in the bottom wall of the handle-casing part of a staple remover in accordance with an embodiment of the present invention, illustrates a lifting blade being inserted into the indentation.
FIG. 27: in a partial transversal cross-sectional view taken along a side portion of the rearward peripheral edge and a rear portion of the side peripheral edge of a blade receiving indentation formed in the bottom wall of the handle-casing part of a staple remover in accordance with an embodiment of the present invention, illustrates a locking prong part of the lifting blade being bended by a locking pin as the lifting blade is being pushed further inside the indentation.
FIG. 28: in a partial transversal cross-sectional view taken along a side portion of the rearward peripheral edge and a rear portion of the side peripheral edge of a blade receiving indentation formed in the bottom wall of the handle-casing part of a staple remover in accordance with an embodiment of the present invention, illustrates the locking blade in its releasably locked position inside the indentation.
FIG. 29: in a partial perspective view, illustrates a staple being pulled rearwardly by a pair of tines part of the claw member, the crown of the staple is shown abuttingly resting on an abutting wall of the blade part of a staple remover in accordance with an embodiment of the present invention.
FIG. 30: in a partial perspective view, illustrates a staple being pulled rearwardly by a pair of tines part of the claw member, the crown section is shown abutting against an abutting wall and the leg section of the staple is shown abutting against a pair of lateral leg abutting walls part of a staple remover in accordance with an embodiment of the present invention.

A blade locking notch 112 is formed in each blade second side wall 110 adjacent the connecting section rearward end 104. Each blade locking notch 112 is adapted to fittingly receive a corresponding blade locking pin 60. As illustrated in FIG. 26 which will be hereinafter described in more details, the connecting section spacing slots 106 allow the connecting section resilient prongs 102 to bend inwardly during insertion of the blade connecting section 70 into the blade receiving indentation 54.

As illustrated more specifically in FIGS. 3 through 5 and 9 through 11, the handle front wall 44 is provided with a claw aperture 114 extending therethrough. The claw aperture 114 allows the claw assembly to protrude through the handle front wall 44. The claw aperture 114 is thus adapted to allow digital access to an actuating section part of the claw assembly 20.

Figure 6:
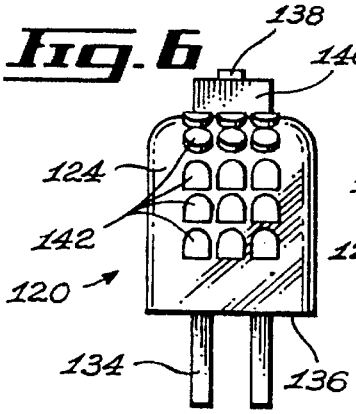
FIG. 6: in a front view, illustrates a claw member part of a staple remover in accordance with an embodiment of the present invention.
Figure 7:
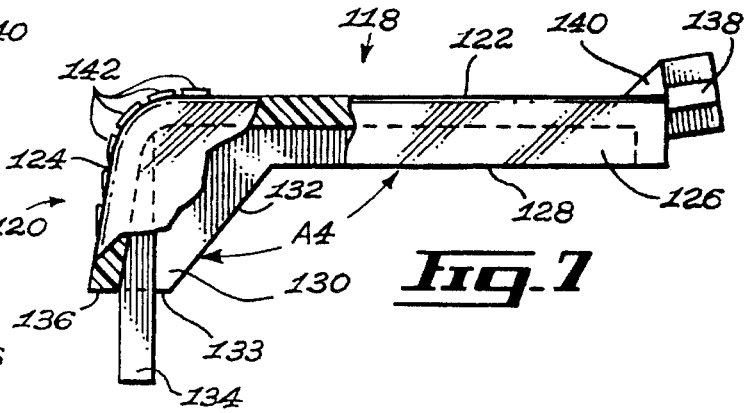
FIG. 7: in an elevational view, illustrates a claw member part of a staple remover in accordance with an embodiment of the present invention.

The claw assembly 20 comprises a claw member 116 illustrated more specifically in FIGS. 6 and 7. The claw member 116 has a substantially "L"-shaped general configuration. The claw member 116 has a substantially elongated claw member first top segment 118 and a substantially perpendicularly and integrally depending claw member front segment 120. The claw member top segment 118 has a claw member top wall 122. The claw member top wall 122 bends integrally and substantially perpendicularly into a claw member front wall 124 part of the claw member front segment 120.

A top segment abutting skirt 126 extends integrally, downwardly and substantially perpendicularly on each side of the claw member top wall 122. The top segment abutting skirt 126 has a substantially rectilinear top abutting skirt surface 128. A front segment abutting skirt 130 extends integrally, rearwardly and substantially perpendicularly from the claw member front wall 124. The front segment abutting skirt 130 has a substantially rectilinear and angled front abutting skirt first surface 132.

The front abutting skirt surface 132 is preferably angled relatively to the top abutting skirt surface 128 by an angle designated in FIG. 7 by the reference characters A4. Typically, the angle A4 has a value substantially in the range of approximately 50 degrees.

The front segment abutting skirt 130 also has a front abutting skirt second surface 133. The front abutting skirt second surface 133 merges integrally at one end with the front abutting skirt first surface 132 and at its other end with the claw member front wall 134. The front abutting skirt second surface 133 is in a substantially parallel relationship with the top abutting skirt surface 128 and is thus angled relatively to the front abutting skirt first surface 132.

A pair of grasping tines 134 extends downwardly from the lower peripheral edge 136 of the claw member front wall 124. The grasping tines 134 are configured, positioned and sized so as to be slidably insertable through the tine receiving slots 96 of the lifting blade 18. A set of anti-skid protuberances 142 extends integrally from the claw member front surface 124 and a front section of the claw member top wall 122.

A spring connecting component 138 extends integrally from the rearward peripheral edge of the claw member top segment 118. A spring abutting block 140 extends integrally from the claw member top wall 122 adjacent its rearwardmost peripheral end. The spring connecting component 138 preferably has a substantially elongated general configuration and a substantially "X"-shaped cross-sectional configuration. Both the spring connecting component 138 and the contacting surface of the spring abutting block 140 are substantially angled relatively to the claw member top wall 122.

A claw member compartment 144 is formed inside the handle-casing member 12. The claw member compartment 144 comprises a top segment first abutment wall 146, a top segment second abutment wall 148, a front segment abutment wall 150 and a front segment structural wall 152.

The front segment structural wall 152 extends integrally from the inner surface of the handle front wall 44 adjacent the lower peripheral edge 154 of the claw aperture 114. The front segment structural wall 152 has a substantially elongated and flat general configuration. The front segment structural wall 152 is in a substantially parallel relationship with the handle bottom wall 38.

The front segment structural wall 152 is provided with a tine receiving slot 156 extending longitudinally therethrough. As will be hereinafter described, the tine receiving slot 156 is adapted to fittingly and slidably receive the grasping tines 134 of the claw member 116. The rearward end of the front segment structural wall 152 extends integrally into the front segment abutment wall 150.

The front segment abutment wall 150 has a forwardly slanting general orientation. The rearward end of the front segment abutment wall 150 extends integrally into the top segment second abutment wall 148.

The top segment second abutment wall 148 has a substantially elongated and flat general configuration. As will be hereinafter disclosed, the top segment second abutment wall 148 is adapted to abuttingly support the top abutting skirt surfaces 128 of the claw member top segment 118.

The top segment second abutment wall 148 has a front abutment wall slot 154 extending longitudinally therethrough. The front abutment wall slot 154 is sized so as to fittingly receive the grasping tines 134 when the front abutting skirt second surface 133 is abuttingly resting on the front segment first abutment wall 150.

The top segment second abutment wall 148 extends integrally from the rearward peripheral end of the front segment second abutment wall 152. The top segment second abutment wall 148 has a substantially elongated and flat general configuration. The top segment second abutment wall 148 is in a substantially parallel relationship with the front segment first abutment wall 150. The top segment second abutment wall 148 is adapted to be in slidable contact with the top abutting skirt surface 128 for abuttingly supporting the claw member top segment 118.

The front segment abutment wall 150 is adapted to act as an abutting stopper means for limiting the movement of the claw member 116 in the claw member compartment 144 by abuttingly contacting the front abutting skirt surface 132 of the claw member 116. The angle between the top segment second abutment wall 148 and the front segment abutment wall 150 is thus substantially in the same range as the angle A4 between the top abutting skirt surface 128 and the front abutting skirt first surface 132. The top segment second abutment wall 148 is in a substantially parallel relationship with the handle bottom wall 38. The top segment second abutment wall 148 extends from the front segment abutment wall 150 to the handle bottom wall 38.

The top segment first abutment wall 146 has a substantially flat and elongated general configuration. The top segment first abutment wall 146 is in an overriding and substantially parallel relationship with the top segment second abutment wall 148. The top segment first abutment wall 146 extends integrally from the inner surface of the handle top wall 42 to the inner surface of the handle bottom wall 38.

The top segment first abutment wall 146 has a spring receiving slot 158 extending longitudinally therethrough. The spring receiving slot 158 is adapted to fittingly receive a biasing component such as a coil-type spring 160. The coil-type spring 160 has a biasing component first end 162 and a biasing component second end 164. A spring abutment wall 166 extends integrally from the interior surface of the handle top wall 42 and the handle bottom wall 38 intermediate the latter. The spring abutment wall 166 is in a substantially perpendicular relationship with the handle bottom wall 38. The spring abutment wall 166 is positioned substantially adjacent the handle rearward wall 40.

As illustrated more specifically in FIG. 14, the first end 162 of the coil-type spring 160 is adapted to be coiled around the spring connecting component 138 and to abut against the spring abutting block 140 both part of the claw member 116. The second end 164 of the coil-type spring 160 is adapted to abut against the spring abutment wall 166.

The handle bottom wall 38 is provided with a container aperture 168 extending therethrough adjacent the handle abutment wall 38. The container aperture 168 has a container aperture upper peripheral edge 170, a container aperture lower peripheral edge 172 and a pair of container aperture side peripheral edges 174.

The inner surface of the handle bottom wall 38 adjacent the container aperture lower peripheral edge 172 is provided with a container locking recess 176. The container locking recess 176 has a substantially rectangular and flat configuration. The container aperture upper peripheral edge 170 has a substantially bevelled locking section 178.

The staple container 22 is adapted to be lockingly abutted against the peripheral edges of the container aperture 168. The staple container 22 has a substantially rectangular and flat container bottom wall 180. A container back wall 182 extends integrally and substantially upwardly from the rearward longitudinal end of the container bottom wall 180. The container back wall 182 preferably has a relatively frontwardly slanted orientation.

A pair of container side walls 184 extends integrally from the side peripheral edges of the container bottom wall 180. The container side walls 184 have a substantially frontwardly tapering configuration. The upper peripheral edges 186 of the container side walls 184 are substantially angled relatively to the container bottom wall 180. The angle between the upper peripheral edges 186 of the container side walls 184 and the container bottom wall 180 has a value substantially equivalent to the value of the angle A1 between the handle bottom wall 38 and the handle abutment wall 34.

A container locking tongue 188 extends integrally from the frontward end of the container bottom wall 180 adjacent its upper surface. The container locking tongue 188 is configured and sized so as to be slidably insertable inside the container locking recess 176.

A container locking prong 190 is formed in the container back wall 182. The container locking prong 190 has a container prong upper section 192 which extends rearwardly and upwardly beyond the upper peripheral edge of the container back wall 182.

A pair of container spacing slots 194 extending through the container back wall 182 on each side of the container locking prong 190 is adapted to allow the latter to resiliently bend forwardly and rearwardly relatively to the container back wall 182. The container prong upper section 192 is configured and sized so as to be adapted to lockingly abut against the bevelled locking section 178 formed in the container aperture upper peripheral edge 170.

The staple container 22 is configured and sized so that when the container side walls 184 and the container back wall 182 abut against the container aperture peripheral edges, the container bottom wall 180 is in a substantially coplanar relationship with the handle abutment wall 34. The handle-casing member 12 and the staple container 22 are thus adapted to form a substantially homogeneous staple container main body.

Figure 8:
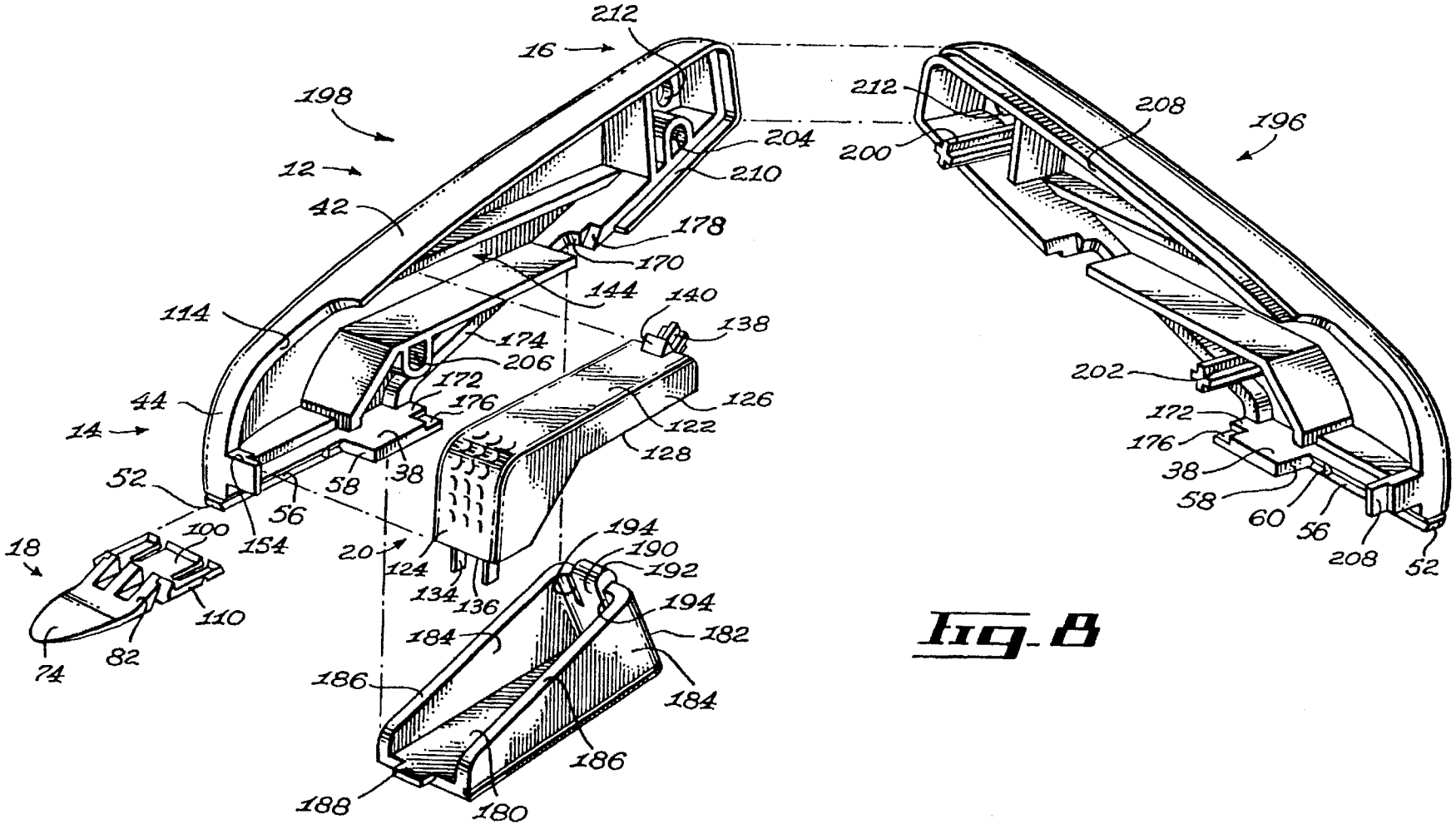
FIG. 8: in a perspective exploded view, illustrates a staple remover in accordance with an embodiment of the present invention.
Figure 10:
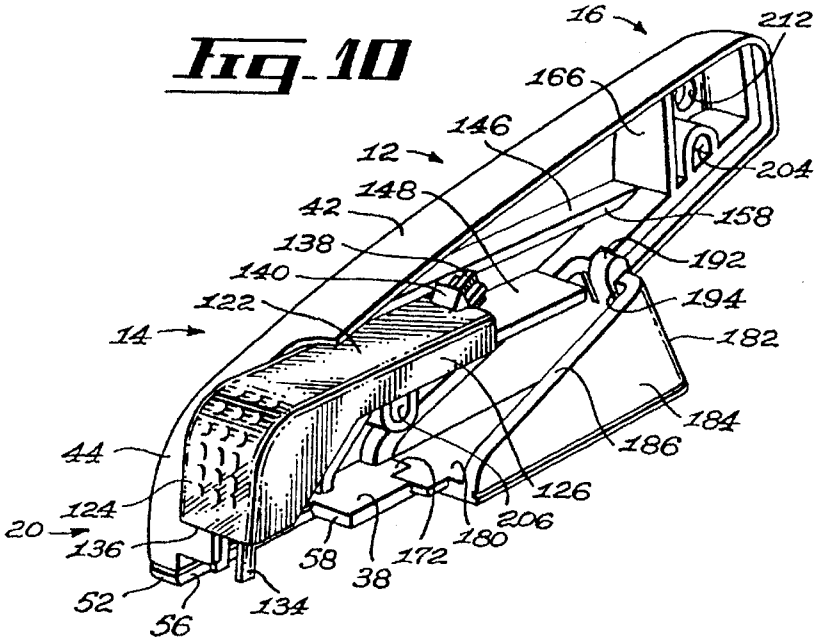
FIG. 10: in a perspective view, illustrates a longitudinal half section of a handle-casing having a claw member and a storage compartment attached thereto, both the claw member and the storage compartment being part of the staple remover in accordance with an embodiment of the present invention.
Figure 9:
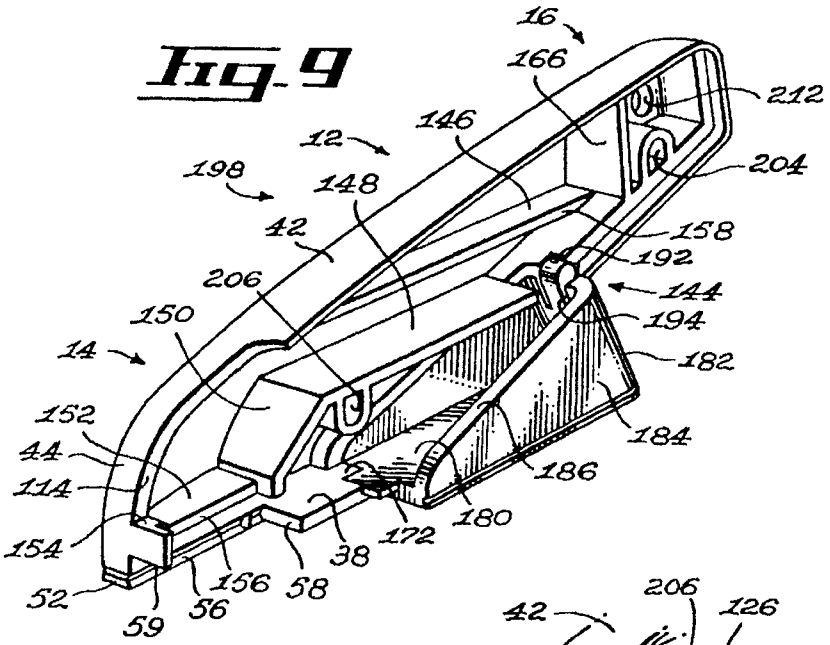
FIG. 9: in a perspective view, illustrates a longitudinal half section of a handle-casing and a storage compartment attached to the latter, both the handle-casing and the storage compartment being part of a staple remover in accordance with an embodiment of the present invention.
Figure 11:
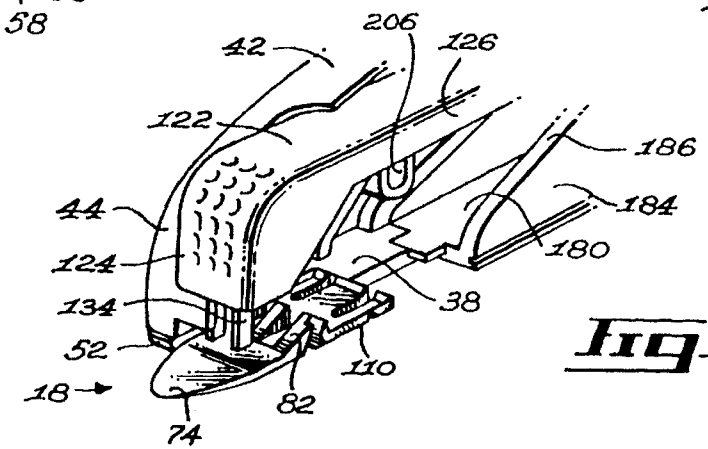
FIG. 11: in a partial perspective view, illustrates a longitudinal half section of a handle-casing having a claw member, a blade and a storage compartment attached thereto, the claw member, the blade and the storage compartment being part of the staple remover in accordance with an embodiment of the present invention.

As illustrated more specifically in FIGS. 5 and 8, the handle-casing member 12 is preferably formed of two relatively symmetrical longitudinal halves sections 196 and 198 so as to facilitate molding, assembly and repair. The halves sections 196 and 198 are relatively similar except for the presence of assembling components used for keeping the halves sections 196 and 198 together.

The half section 196 is provided with a pair of assembling pins 200 and 202 extending substantially perpendicularly from their respective handle side wall 46. Both the assembling pin 200 and the assembling pin 202 preferably have a substantially "X"-shaped cross-sectional configuration. A set of corresponding assembling pin receiving channels 204 and 206 extends integrally and substantially perpendicularly from their respective handle side wall 46.

The assembling pin receiving channels 204 and 206 are configured and sized so as to fittingly receive respectively the assembling pin 200 and 202 when the halves sections 196 and 198 are assembled together. Typically, the assembling pin 200 and the corresponding assembling pin receiving channel 204 are located adjacent the handle rearward wall 40, while the assembling pin 202 and the corresponding assembling pin receiving channel 206 are positioned adjacent the front segment abutment wall 150.

The handle bottom wall 38, the handle rearward wall 40, the handle top wall 42 and the handle front wall 44 of each half section 196 and 198 are all provided with a pair of peripheral lips 208 and 210. The peripheral lip 208 extends integrally from the interior cross-sectional half of the walls while the peripheral lip 210 extends integrally from the exterior cross-sectional half of the walls. The peripheral lips 208 and 210 are adapted to overlap each other when the halves sections 196 and 198 are assembled together.

A pair of fastening apertures 212 extends through both handle side walls 46. The fastening apertures 212 are typically located adjacent the handle rearward wall 40 and are substantially in register with each other. The fastening apertures 212 are adapted to receive conventional fastening elements such as a nut and bolt assembly or the like for releasably fastening the 196 and 198 together.

The specific configuration of the staple remover 10 allows for all of its components except for the coil-type spring 160 to be manufactured out of a polymeric resin using a conventional injection molding process.

Operation:

In use, in order to remove a staple such as the staple 30 illustrated in FIGS. 1 and 2, the staple remover 10 is first abuttingly rested on the top surface 24 of the pile formed by the stapled sheets 26. The staple remover 10 is abuttingly rested on the top surface 24 with the handle abutment wall 34 and the substantially coplanar container bottom wall 180 contacting the top surface 24. The staple remover 10 is then manipulated so as to substantially align the arcuate frontward peripheral edge 72 of the lifting blade 18 with the crown section 30 of the staple 28.

The user then slides the staple remover 10 forwardly towards the staple 28 as indicated by arrow D1 in FIG. 2. As mentioned hereinbefore, the angle A1 between the handle bottom wall 38 and the handle abutment wall 34 allows for an ergonomical positioning of the wrist 50 of the user during the sliding operation.

Furthermore, the relatively large contacting surface between the top surface 24 of the stack of stapled sheets 26 and the combination of the handle abutment wall 34 and the container bottom wall 180 facilitates handling of the staple remover 10 since it stabilizes the latter during the sliding operation.

The staple remover 10 is slid forwardly until, as illustrated in FIG. 2, the arcuate frontward peripheral edge 72 penetrates in the spacing between the crown section 32 of the staple 28 and the top surface 24 of the stack of stapled sheets 26.

Further forward movement of the staple remover 10 causes the crown section 30 to contact the frontwardly tapering insertion section top wall 74 part of the lifting blade 18. At this stage, forward movement of the staple remover 10 causes the insertion section top wall 78 to impart a strong lifting action on the crown section 30 of the staple 28. The lifting action in turn causes the leg sections 32 to straighten as illustrated by the leg sections 32' of the staple 28' in FIG. 15.

Continued forward movement of the staple remover 10 causes the now at least partially unclenched staple 28' to clear the blade insertion section 64 and the crown section 30 to contact the intermediate section top wall 78. Still further forward movement of the staple remover 10 causes the crown section 30 of the staple 28' to slide underneath the grasping tines 134.

Figure 15:
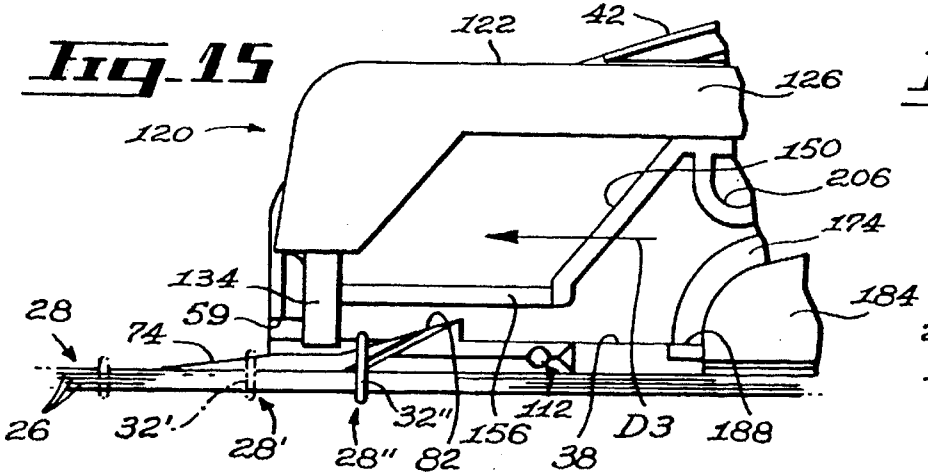
FIG. 15: in a partial elevational view of a longitudinal half section of a handle-casing part of a staple remover in accordance with an embodiment of the present invention, illustrates the interaction between a lifting blade and a clenched staple as the lifting blade is being inserted between a sheet of stapled material and the clenched staple.

Having slid underneath the grasping tines 134, further forward movement of the staple remover 10 causes the staple to reach the blade lifting section 68 as illustrated by the staple 28" in FIG. 15. The staple 28" is illustrated with its legs 32" in their substantially straighten configuration.

Once the staple 28" has cleared the grasping tines 134, the user digitally pushes rearwardly on the claw member front wall 124 as illustrated by arrow D2 in FIGS. 3 and 16 through 19. The claw member 116 is adapted to translate inside the claw member compartment 144 between a first extracted position illustrated in FIGS. 14 and 15 and a second retracted position illustrated in FIG. 19. The claw member 116 is biased towards the extracted first position by the coil-type spring 160.

In the first position illustrated in FIGS. 14 and 15, the coil-type spring 160 biases the claw member 116 frontwardly. The biasing force exerted on the claw member 116 by the coil-type spring 116 is schematically illustrated in FIG. 15 by the arrow D3. The frontward movement of the claw member 116 is limited by the locking tines 134 which abut against a segment of the handle front wall 44 which extends between the claw aperture lower peripheral edge 154 and the upper peripheral edge of the clearance indentation 59.

Figure 19:
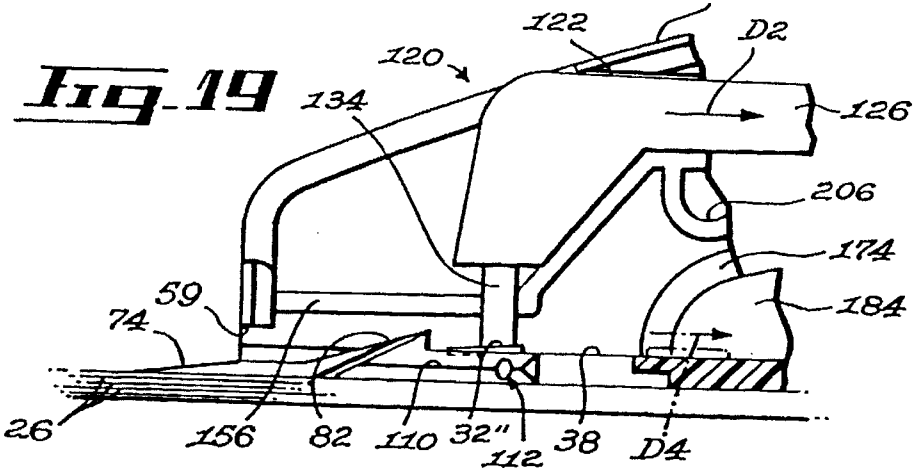
FIG. 19: in a partial elevational view of a longitudinal half section of a handle-casing part of a staple remover in accordance with an embodiment of the present invention, illustrates the action of a claw member as it pulls a staple towards the storage compartment, the staple is shown abutting against the fixing section of the lifting blade.

In the second fully retracted position illustrated in FIG. 19, the rearward translational movement of the claw member 116 is limited by the front abutting skirt second surface 132 part of the front segment abutting skirt 130 which abuts against the front segment abutment wall 150.

During the translational movements between the first position and the second position, the claw member 116 is guided by the top segment first abutment wall 146 and the top segment second abutment wall 148 which abuttingly contact respectively the claw member top wall 122 and the top abutting skirt surface 128 part of the top segment abutting skirt 126. During the translational movement of the claw member 116 in the claw member compartment 144 between the first position and the second position, the spring abutting block 140 and the spring connecting block 138 reciprocate inside the spring receiving slot 158, while the grasping tines 134 reciprocate inside the tine receiving slot 156.

Figure 3:
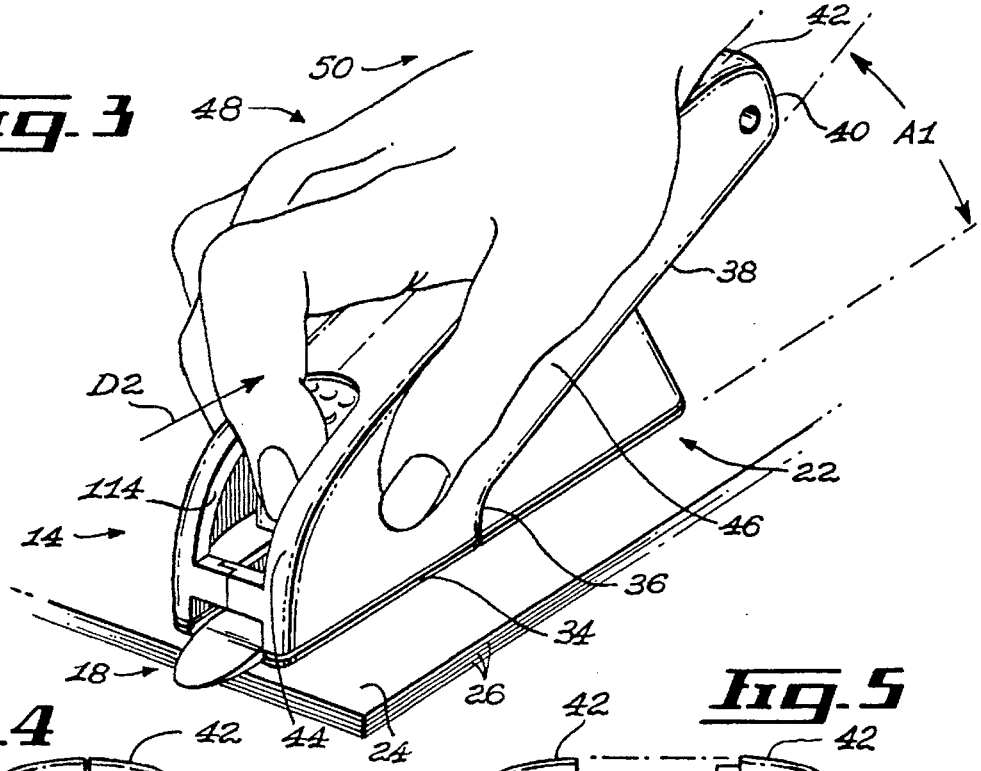
FIG. 3: in a perspective view, illustrates a staple remover in accordance with an embodiment of the present invention. The staple remover is shown in a situation wherein the index finger of a user pulls on a claw member part of the staple remover so as to pull a removed staple into a storage compartment also part of the staple remover.

When the claw member 116 is in the first position, the claw member front wall 124 and a portion of the claw member top wall 122 protrude through the claw aperture 114. As illustrated in FIG. 3, a user can thus easily digitally press on the claw member 116 while retaining its grip on the handle side walls 46. The anti-skid protuberances 142 are adapted to prevent the finger exerting the pressure on the claw member 116 from sliding off the claw member front wall 124.

Figure 16:
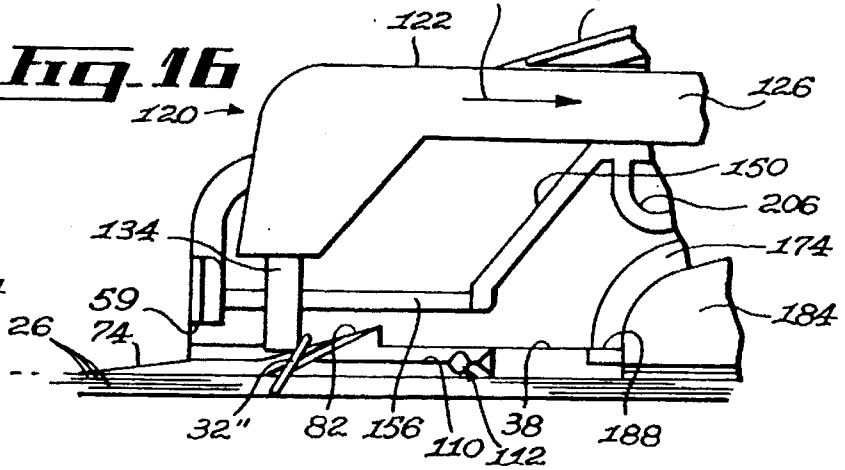
FIG. 16: in a partial elevational view of a longitudinal half section of a handle-casing part of a staple remover in accordance with an embodiment of the present invention, illustrates the action of a claw member as it begins pulling a staple towards the storage compartment.

Referring now back to FIG. 16, the pressure exerted by the finger of the user on the claw member front wall 124 causes the latter to move from the first position towards the second position.

The rearward movement of the claw member 116 causes the grasping tines 134 to abuttingly contact the crown section 30 and to pull the latter upwardly along the crown abutting wall 82. The rearward displacement of the grasping tines 134 is schematically indicated in FIGS. 29 and 30 by the reference characters D7.

The rearward movement of the grasping tines 134 eventually causes the leg sections 32 to come in abutting contact with the leg abutment wall 90 as illustrated in FIGS. 16 and 30.

Preferably, the lower peripheral edge of the leg abutment wall 90 may have a relatively thin section which extends in a plane substantially perpendicular to the blade bottom wall 62. This relatively thin section is adapted to prevent the corner end piece of the lower peripheral edge of the leg sections 32 from unwantingly gripping the lower peripheral edge of the leg abutment wall 90.

Figure 17:
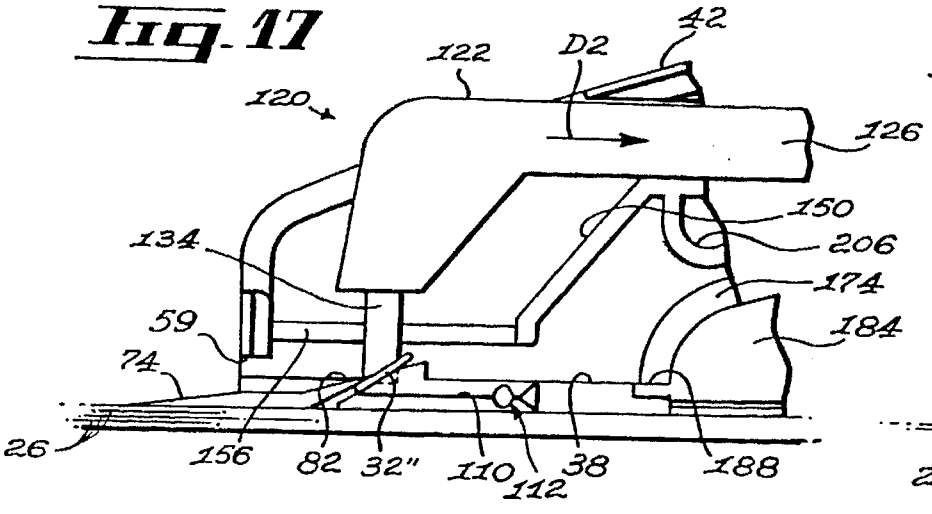
FIG. 17: in a partial elevational view of a longitudinal half section of a handle-casing part of a staple remover in accordance with an embodiment of the present invention, illustrates the action of a claw member as it pulls a staple towards the storage compartment, the staple is shown abutting against the abutment wall sections part of the lifting blade.

Depending on considerations such as the type and size of the staple used and the thickness of the pile of stapled sheets 26, the lower peripheral end of the leg sections 32 may remain partially inwardly bended even after being completely extracted from the pile of stapled sheets 26 as illustrated in FIG. 30. When such a situation occurs, the inwardly bended lower end of the leg sections 32 is adapted to slidably penetrate inside the leg receiving slots 94 as illustrated in FIGS. 17 and 30. The leg receiving slots 94 thus prevent the potentially inwardly bended lower end of the leg sections 32 from frictionally abutting against the blade first side walls 86 and potentially prevent jamming of the staple 28 as it is being pulled upwardly on the blade lifting section 68.

The presence of the leg receiving slots 94 allows for the use of the lifting blades 18 which are preselected so as to have a width W corresponding substantially to the length of the crown section 30. Indeed, as will be hereinafter disclosed, the present invention allows for the use of interchangeable lifting blades 18 customized to the type and size of the staples which are removed. By allowing the user to select blades customized to the size and type of staples, the present invention further optimizes the staple removing efficiency and reduces the risks of having a staple 28 jammed during the staple removing operation.

Figure 18:
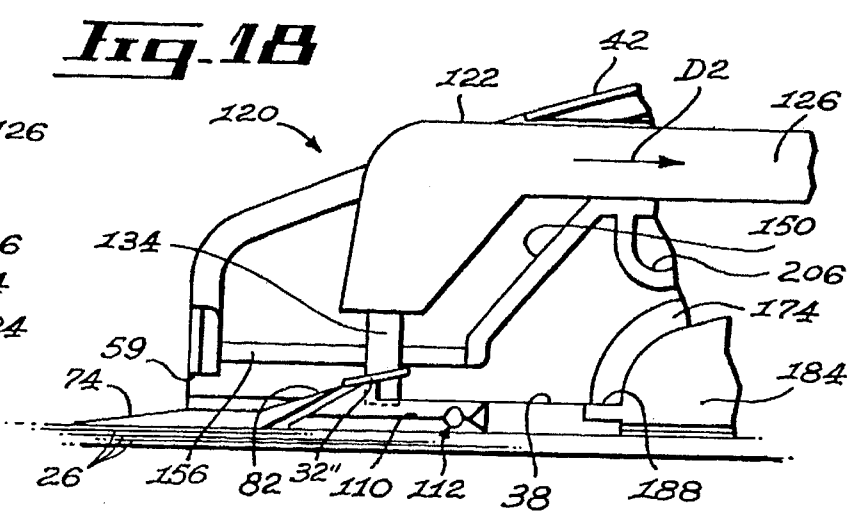
FIG. 18: in a partial elevational view of a longitudinal half section of a handle-casing part of a staple remover in accordance with an embodiment of the present invention, illustrates the action of a claw member as it pulls a staple towards the storage compartment, the staple is shown as it clears the upper peripheral edge of the abutting walls part of the lifting blade.

As illustrated in FIGS. 15 through 18, the staple 28 being pulled upwardly along the blade lifting section 68 is not only raised upwardly away from the top surface 24 of the pile of stapled sheets 26 but is also pivoted about the crown section 30 between a position illustrated in FIG. 15 wherein the leg sections 32 are in a substantially perpendicular relationship with the top surface 24 and a position illustrated in FIG. 18 wherein the leg sections 32 are in a substantially parallel relationship with the top surface 24.

As illustrated in FIGS. 18 and 19, further rearward movement of the claw member 116 causes the crown section 30 and the leg section 32 of the staple 28 to clear the upper peripheral edge 92 of the lifting section back wall 88 and to fall onto the connecting section central blade 100 and the connecting section resilient prongs 102.

As illustrated in FIG. 19, when the claw member 116 is in the second position with the front segment abutting skirt 130 abutting against the front segment abutment wall 150, the grasping tines 134 have pulled the staple 28 sufficiently rearwardly to enable the staple 28 to clear the upper peripheral edge 92 of the lifting section back wall 88 and to allow the staple 28 to drop onto the top surface of the blade connecting section 70.

When the second position is reached by the claw member 116, the user releases the digital pressure exerted on the handle front wall 44, causing the coil-type spring 160 to bias the claw member 116 back to its original first position illustrated in FIG. 14.

The staple 28 having been pivoted about the crown section 30 during its ascension on the blade lifting section 68, when the staple 28 falls onto the top surface of the blade connecting section 70, the leg sections 32 are typically in an abutting relationship with the top surface of the connecting section 70 as illustrated in FIG. 19.

The staples 28 are prevented from sliding back down from the blade lifting sections 68 by the lifting section back wall 88. The staples 28 thus remain inside the handle-casing member 12. The removed staples 28 inside the handle-casing member 12 are adapted to slide rearwardly on the top surface of the blade connecting section 70 towards the staple container 22 as illustrated in phantom lines in FIG. 19.

Another main feature of the present invention resides in the ergonomic construction of the staple container 22. The staple container 22 is adapted to receive and store the removed staples which have been removed from the stapled sheets 26 by the lifting blade 18 and the claw assembly 20. As illustrated in FIG. 14, the staple container 22 is releasably fixed to the handle-casing member 12.

Figure 20:
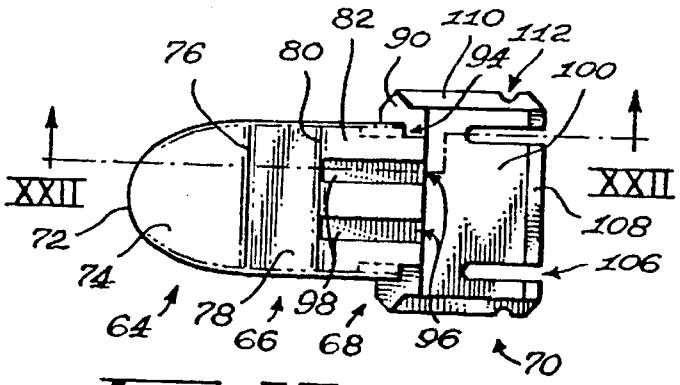
FIG. 20: in a top view, illustrates a first embodiment of a blade part of a staple remover in accordance with an embodiment of the present invention.

FIGS. 20 and 24 illustrate two different embodiments of the lifting blade 18. As can be seen by comparing the width of the blade of both embodiments, the width of the embodiment illustrated in FIG. 24 is substantially narrower than the width of the embodiment illustrated in FIG. 20.

The lifting blades 18 are adapted to be inserted and retracted from the blade receiving indentation 54 respectively by a simple pushing and pulling action. The corresponding cross-sectional configurations of the indentation side walls 56 and the blade second side wall 110 facilitates the guiding of the lifting blade 18 in the blade receiving indentation 54 during insertion and retraction from the latter. The lifting blade 18 is adapted to be releasably locked inside the blade receiving indentation 54 by the blade locking notches 112 and the corresponding blade locking pins 60.

FIGS. 26 through 28 illustrate the interaction between the blade connecting section 70 and the blade receiving indentation 54 during insertion of the lifting blade 18. The reference characters D5 illustrate the motion of the lifting blade 18 as it is being pushed inwardly inside the blade receiving indentation 54. When the rearward peripheral end of the connecting section resilient prongs 102 reaches the blade locking pin 60, the latter bends the connecting section resilient prongs 102 inwardly as illustrated by arrow D6. The connecting section spacing slots 106 are adapted to allow resilient bending of the connecting section resilient prongs 102. The bending action of the cavity connecting section resilient prongs 102 is schematically illustrated by the arrow indicated by the reference characters D6.

When the blade locking notch 112 reaches the blade locking pin 60, the connecting section resilient prongs 102 resiliently snap back to their original position, thus releasably locking the lifting blade 18 inside the blade receiving indentation 54 as illustrated in FIG. 28.

In comparison to the known prior art, the invention is more convenient to operate, more efficient and fully competitive in terms of manufacturing costs and practicality. Its advantages should now be apparent to those skilled in the art.

It is to be understood that the form of the invention herewith shown and described is to be taking as an example of the same, and that various changes in the shape, size and arrangement of parts may be resorted to, without departing from the spirit of the invention or scope of the sub-joined claims.

The embodiments of the invention in respect of which an exclusive property or privilege is claimed are described as follows:

1. A staple remover for removing a staple from a sheet of material, said staple having a crown section and a pair of integrally depending staple legs, said sheet having a sheet top surface, said staple remover comprising:

a main body, said main body having a main body frontward end and a main body rearward end, a removed staples storage compartment formed in said main body for temporarily storing removed staples, a staple removing blade for disengaging said staple from said sheet, said staple removing blade being attached to said main body frontward end, a communicating means positioned between said staple removing blade and said removed staples storage compartment for allowing through passage of said staple from said staple removing blade to said removed staples storage compartment, a claw member slidably mounted to said main body, said claw member having a claw member contacting section for abuttingly contacting said crown section of said staple, said claw member being slidable between a claw first position wherein said claw member contacting section is in a substantially overlying relationship with said staple removing blade and a claw second position wherein said claw member contacting section is in a substantially overlying relationship with said communicating means whereby, said staple removing blade is adapted to be slid between said top surface of said sheet of material and said crown section of said staple for disengaging the latter from said sheet and said claw member is adapted to pull said staple from said staple removing blade to said communicating means, towards said used staple storage compartment.

2. A staple remover as recited in claim 1 wherein said staple remover further comprises a biasing means for biasing said claw member towards said claw first position.

3. A staple remover as recited in claim 1 wherein said main body comprises a handle member and wherein said removed staples storage compartment is releasably fixed to said handle member.

4. A staple remover as recited in claim 1 wherein said staple removing blade is releasably attached to said main body frontward end.

5. A staple remover as recited in claim 1 wherein said communicating means includes a stopping means for selectively allowing said staple to move from said staple removing blade to said removed staples storage compartment while preventing said staple from moving from said removed staples storage compartment to said staple removing blade.

6. A staple remover as recited in claim 1 wherein said communicating means is a passage formed in said main body.

7. A staple remover as recited in claim 3 wherein said handle member is provided with an internal guiding means for guiding said slidable movement of said claw member between said first claw position and said second claw position.

8. A staple remover as recited in claim 7 wherein said staple removing blade has a blade bottom surface, said handle member comprising a substantially flat handle abutment wall and a substantially hollow and elongated grasping section, said grasping member extending substantially upwardly and rearwardly from said handle abutment wall, said handle abutment wall having an abutment wall frontward peripheral edge, said abutment wall frontward peripheral edge having a blade receiving indentation formed therein, said blade receiving indentation being adapted to slidably receive and releasably attach therein said staple removing blade with said blade bottom surface in a substantially coplanar relationship relatively to said handle abutment wall, said grasping member having a grasping member frontward end, said grasping member frontward end being provided with a notch extending from said blade receiving indentation for allowing through passage of said staple from said blade to a position inside said grasping member.

* * * * *